US005651274A

United States Patent [19]

Taylor

[11] Patent Number: 5,651,274

[45] Date of Patent: Jul. 29, 1997

[54] LOCKETS

[75] Inventor: Michael John Taylor, West Midlands, England

[73] Assignee: Gold Connection Limited, England

[21] Appl. No.: 650,693

[22] Filed: May 20, 1996

[51] Int. Cl.[6] ..... A44C 15/00

[52] U.S. Cl. ..... 63/18; 63/19

[58] Field of Search ..... 63/18, 19, 2; 40/647

[56] References Cited

U.S. PATENT DOCUMENTS 5,586,452 12/1996 Schmid ..... 63/19

FOREIGN PATENT DOCUMENTS 0716900 10/1954 United Kingdom .

0749954 6/1956 United Kingdom .

0837254 6/1960 United Kingdom .

2267426 12/1993 United Kingdom ..... A44C 25/00

*Primary Examiner*—Kien T. Nguyen

*Attorney, Agent, or Firm*—Ice Miller Donadio & Ryan; Doreen J. Gridley

[57] ABSTRACT

A locket comprising a front cover and a back cover shaped to accommodate a leaf interposed between the covers when the locket is closed, wherein the leaf comprises an annular member having a central plane, a radially inner portion and a radially outer portion, the radially inner portion being thicker than the radially outer portion in a direction transverse to the central plane, such that the radially inner portion is thick enough to carry a photograph, picture etc whilst the radially outer portion is relatively thin thereby reducing the overall thickness of the locket.

20 Claims, 3 Drawing Sheets

LOCKETS

This invention relates to lockets.

Lockets have been around for many years, and come in a great variety of shapes and sizes. Lockets often have the facility to receive a small picture or photograph at the inside of their front or back cover, or sometimes both. An additional leaf is sometimes provided, interposed between the covers, which accommodates further pictures, photographs etc. However, such lockets are often bulky due to the thickness of the covers and the additional leaf.

According to a first aspect of the invention there is provided a locket comprising: a front cover; a back cover; a leaf comprising an annular member having a central plane; wherein the leaf is interposed between the front cover and the back cover when the locket is closed, and the covers are shaped to accommodate the annular member; and wherein the annular member has a radially inner portion and a radially outer portion, the radially inner portion being thicker than the radially outer portion in a direction transverse to the central plane.

In this way, the radially inner portion of the leaf can be made thick enough to carry a picture or photograph etc., whilst the radially outer portion can be relatively thin, reducing the overall thickness of the locket. A locket of slim appearance is therefore provided, which can carry additional pictures etc.

The radially inner portion and the radially outer portion of the annular member may define a surface on each side of the central plane. One or both surfaces may be outwardly inclined away from the central plane. When both surfaces are so inclined, they are inclined in opposite directions. One or both of the surfaces may be annular in shape, or may be in the form of discs.

Each cover may comprise a cover body, and a cover rim having a cover rim surface. Each cover rim surface may be inwardly inclined towards the respective cover body, such inward inclination allowing the cover rim surface to accommodate the or one of the outwardly inclined surfaces of the annular member.

The inclination of one or both of the surfaces of the annular member and one or both of the cover rim surfaces may be such that these surfaces abut and extend generally parallel to each other.

A portion of the leaf may constitute part of the external surface of the locket, or the leaf may be fully housed within the covers when they are closed.

Preferably the front and back covers and the leaf are of substantially the same area and shape. Alternatively, the covers may be of different area and shape, and the leaf could be smaller or larger than one or both of these.

The or each cover may have an annular wall one side of which defines the cover rim surface and the other, opposite side of which defines in part an annular recess. An inner surface of each cover body may, at its peripheral regions, also part-define the annular recess.

The leaf may also comprise a recess or recesses.

The recesses may be adapted to receive one or more items such as pictures, photographs, blank or decorated plates, protective panels packing sheets etc. The items may be removable.

The leaf may have removable pictures etc on each side of the central plane, or it may have only one side which can receive a picture, the other side receiving a blank or decorated plate. Alternatively both sides of the leaf may be capable of receiving a plate, there being no pictures etc associated with the leaf.

If pictures or photographs are received by the covers or leaf, these may be covered by a protective panel, also received in the recesses. The protective panels may be sold as part of the locket, these being removed to place for example a photograph or photographs in the covers and/or leaf. The protective panel or panels may then be replaced, covering the photographs to protect them.

A packing sheet may be provided in each or both of the covers and/or the leaf. These may be used to partially fill the recesses, allowing thinner photographs, plates etc to be accommodated therein. The packing sheets may have the purpose of concealing inner surfaces of the cover bodies. These surfaces need not then be finished to such a high degree as outer surfaces of the cover bodies.

Alternatively the front and/or back covers may comprise an integral plate forming the inner surfaces thereof. This could be blank or decorated. Similarly, the leaf could have an integral plate on one or both of its sides, integral with the annular member.

At the annular recess of one or each cover there may be provided a roughened area. This roughened area may extend under the annular wall of the cover, and may comprise projections and indentations from a decorative pattern pressed into an annular region of the outer surface of the cover body.

A picture etc which is located in the annular recess may have a peripheral region which engages the roughened area thereby assisting in retaining the picture in the recess.

Preferably the front and back covers and the leaf are connected together at the same hinge.

The locket may have a flattened region so that it can stand on a flat surface.

More than one leaf may be provided by the locket.

According to a second aspect of the invention there is provided a method of holding and protecting one or more photographs in a locket as described in the first aspect of the invention, comprising the steps of:

removing the or each protective panel from the or each cover and/or the leaf, placing the or each photograph in the or each cover and/or the leaf, replacing the or each protective panel in the or each cover and/or leaf such that the or each photograph is covered and protected thereby.

Embodiments of the invention will now be described with reference to the accompanying drawings of which:

Figure 1:
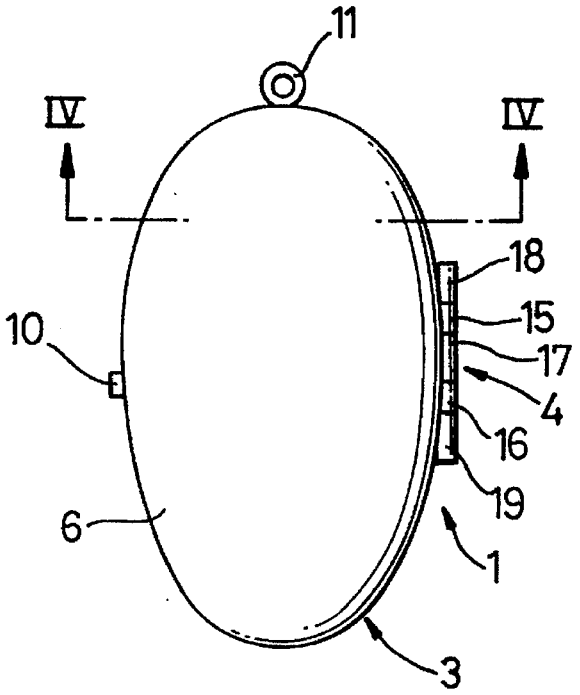
FIG. 1 is a plan view of a locket from behind.

FIGS. 1 to 5 show details of a locket 1 having a front cover 2 hinged to a back cover 3 via a hinge 4, and an intermediary leaf 5 between the front and back covers and also pivotally hinged to the hinge 4.

The back cover 3 has a concave cover body 6 and a cover rim 7 which has a cover rim surface 25. An annular recess 8 is formed by an inner surface 31 of the cover body 6 and an inner surface 32 of the cover rim 7. A photograph 9 is received in the recess 8. A transparent plastic panel 30 is also received in the recess 8 so as to cover the photograph 9 thereby protecting it. The back cover 3 also has a catch bar 10 which engages in use with the front cover 2 so as to hold the locket closed. A ring 11 is also provided at the top of the back cover 3 to enable the locket to be hung from a chain. The back cover 3 also has a slight recess (not shown) in its outer surface adjacent to leaf 5 to enable a thumbnail or fingernail to be introduced between the cover and the leaf so as to open the locket.

The front cover 2 is similar in shape and size to the back cover 3 and corresponding structure have been given corresponding reference numerals. It does not have a ring 11, or a thumbnail recess.

The leaf 5 has an annular member 12 surrounding an open central space. The member has a central plane, and in a direction transverse to this a radially inner portion of the member is thicker than a radially outer portion. These portions define two surfaces 26, 27, one on either side of the central plane. The member 12 has an internal groove 13 extending around its inner peripheral edge in which is received two back-to-back photographs 14 so as to present pictures to each side of the leaf. A transparent plastic panel 35 is received in the groove 13 to cover each of the photographs, thereby protecting them. The member is shaped such that the radially inner portion is thick enough to receive the photographs and panels, whilst the radially outer portion, which forms part of the external surface of the locket is much thinner. Thus the overall thickness of the locket is reduced.

Any one, or all of the photographs in the locket can be removed and replaced by another. Items other than photographs can be received in the covers and leaf, and the protective panels can be used or not.

The leaf 5 is connected to the hinge 4 by two hinge tubes 15 and 16 which are integral with the annular member 12. The front cover 2 is integral with a central hinge tube 17, and the back cover 3 is integral with outer hinge tubes 18 and 19. A hinge pin passes through each of the hinge tubes to connect them together.

Figure 2:
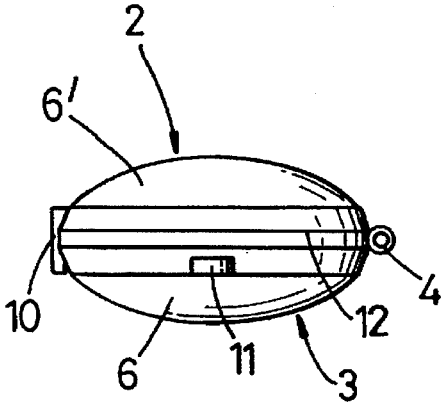
FIG. 2 is a top view of the locket of FIG. 1 with the locket in a closed configuration.
Figure 3:
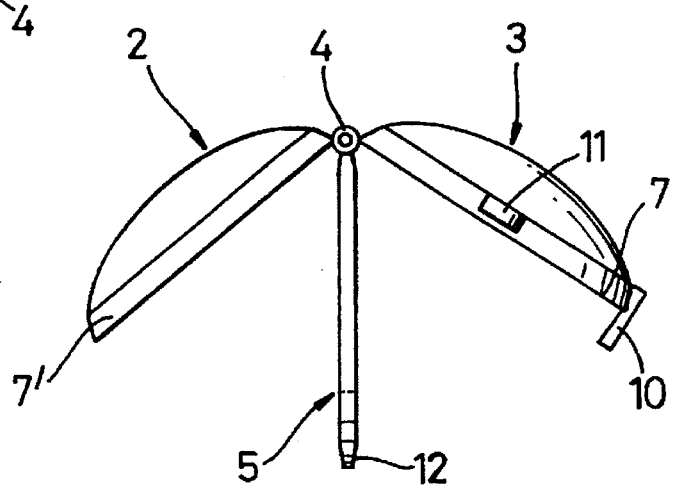
FIG. 3 is a top view of the locket of FIG. 1 with the locket in an open configuration.
Figure 4:
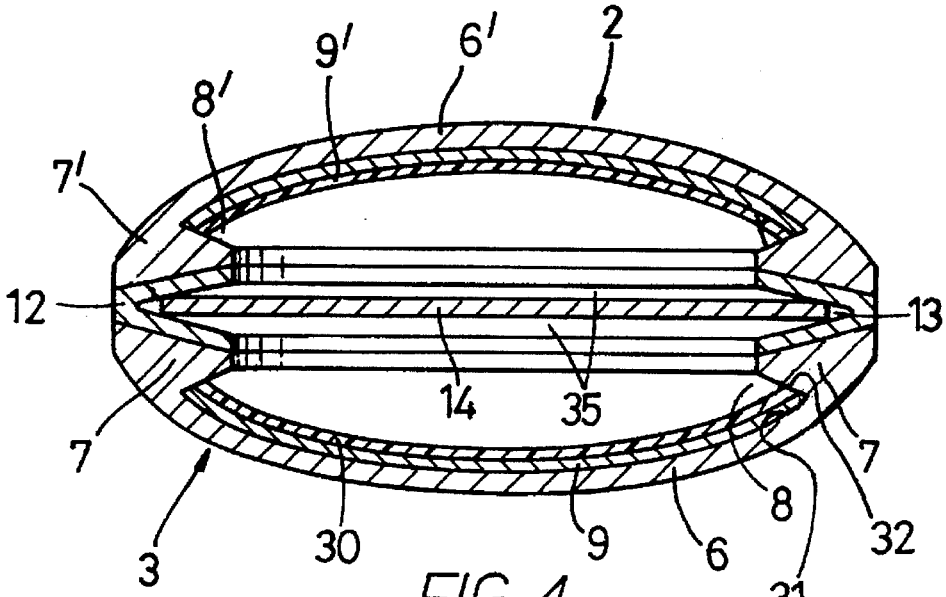
FIG. 4 is a cross section on line IV to IV of FIG. 1.

The user can open the locket from its configuration shown in FIG. 2 to that shown in FIG. 3, and that the leaf 5 can pivot relative to the front and back covers to enable each of its pictures to be seen more clearly. It can be placed to overlie the front or back cover so as to effectively give the appearance of a conventional locket when opened.

Figure 5:
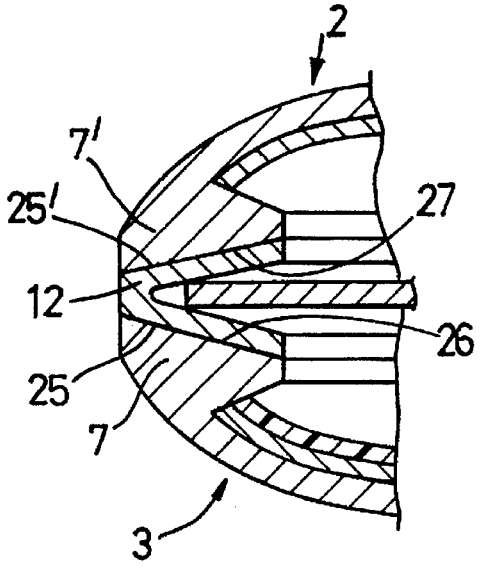
FIG. 5 is an enlarged partial view of FIG. 4.
Figure 7:
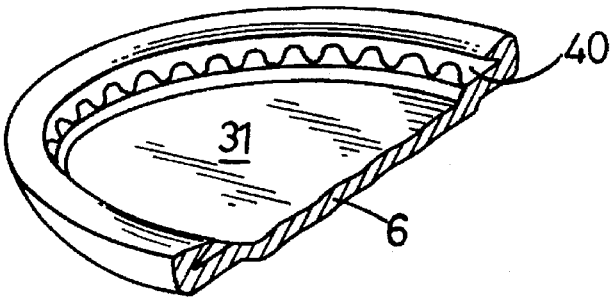
FIG. 7 is a partial perspective view of the inner surface of the back cover of the locket.
Figure 6:
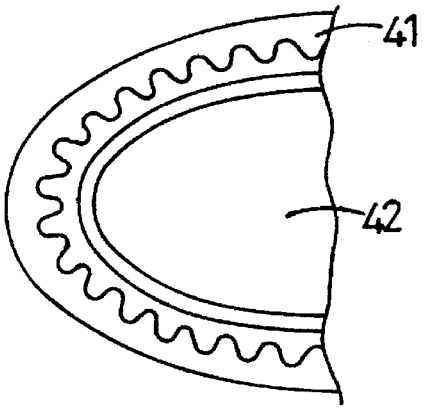
FIG. 6 is a partial plan view of the outer surface of the back cover of the locket.

As can be seen from FIG. 5, the cover rim surfaces 25, 25' of the back and front covers are inwardly inclined towards their respective cover bodies 6, 6'. The surfaces 26, 27 of the leaf are outwardly inclined from the central plane of the leaf. When the locket is closed, the cover rim surface 25 abuts the surface 26, and the cover rim surface 25' abuts the surface 27. Because these are inclined, the leaf fits substantially within the front and back covers. Thus only a relatively small thickness of the member 12 forms part of the external surface of the locket, and a locket which is slim in appearance is provided As can be seen from FIG. 7, at the annular recess of the cover body 6, there is a toughened area 40. This is formed in the inner surface 31 of the cover body, and comprises projections and indentations from a decorative pattern 41 formed in an outer surface 42 of the cover body 6 (FIG. 6). The front cover may have a similar roughened area. When a photograph, picture etc is inserted into the annular recess, the peripheral region of the photograph engages the roughened area, and this helps to retain the photograph in the recess.

The above describes the preferred embodiment of the locket. It will be appreciated that numerous variations to this may be made without departing from the basic principle.

For example, the leaf 5 could have a central plate integral with the annular member and extending across the plan area of the locket, which could bear an inscription. The leaf may thus have one side capable of containing a photograph and the other side bearing an inscription. Alternatively both sides of the leaf may be solid and may bear an inscription. The leaf may have a solid central plate integral with the annular member and separate photograph-retaining recesses provided to each side of the plate by annular rims (this would look something like the arrangement of FIG. 4 but with the photographs 14 being replaced by a plate integral with the leaf 5, and appropriate recesses to either, or just one, side of the plate). Similarly, a plate may be provided in the recess of or integrally with either or both of the front and back covers.

The locket may have a flattened portion, for example at its base, to enable the locket to be stood up on a bedside table when opened.

Figure 8:
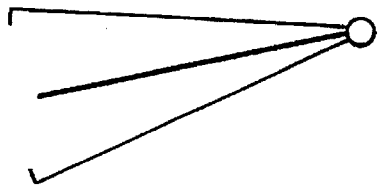
FIGS. 8 and 9 show schematically alternative lockets.

The intermediary leaf may be smaller than the front and back covers and may be held substantially wholly within them when the locket is closed (FIG. 8). Of course, the front and back covers need not necessarily be of the same size or shape, one could be smaller than the other.

Figure 9:
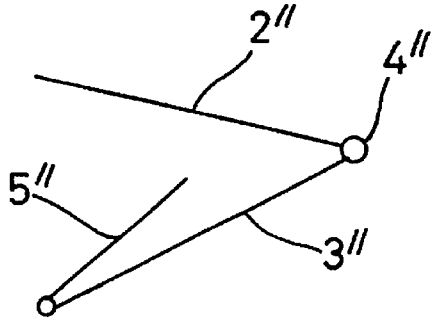

The leaf may be hinged to the outer peripheral edge of a chosen one of the front or back covers, as in FIG. 9.

Two or more leaves may be provided. These would preferably be hinged together at the same point, however, we may choose to have leaves hinged to the locket at different points. For example we could have a combination of the leaf 5 in FIG. 3 and the leaf 5" of FIG. 9.

What I claim is:

1. A locket comprising:

a front cover;

a back cover;

a leaf comprising an annular member having a central plane;

wherein said leaf is interposed between said front cover and said back cover when said locket is closed, and said covers are shaped to accommodate said annular member;

and wherein said annular member has a radially inner portion and a radially outer portion, said radially inner portion being thicker than said radially outer portion in a direction transverse to said central plane.

2. A locket according to claim 1, wherein said radially inner portion and said radially outer portion define a surface, said surface being outwardly inclined away from said central plane, and one cover comprises a cover body and a cover rim having a cover rim surface, said cover rim surface being inwardly inclined towards said cover body such as to accommodate said surface defined by said radially outer portion and said radially inner portion.

3. A locket according to claim 2, wherein said outwardly inclined surface of said annular member abuts and extends generally parallel to said inwardly inclined cover rim surface.

4. A locket according to claim 1, wherein said radially inner portion and said radially outer portion define two surfaces, said surfaces being outwardly inclined away from said central plane in opposite directions, and each cover comprises a cover body and a cover rim having a cover rim surface, said cover rim surfaces being inwardly inclined towards respective cover bodies such as to accommodate said surfaces defined by said radially outer portion and said radially inner portion.

5. A locket according to claim 4, wherein one outwardly inclined surface of said annular member abuts and extends generally parallel to one inwardly inclined cover rim surface.

6. A locket according to claim 4, wherein both outwardly inclined surfaces of said annular member abut and extend generally parallel to said inwardly inclined cover rim surfaces.

7. A locket according to claim 1, wherein a portion of said leaf constitutes part of the external surface of said locket when said locket is closed.

8. A locket according to claim 1, wherein said leaf is fully housed within said covers when said locket is closed.

9. A locket according to claim 1 wherein said leaf is the same shape as either or both of said covers.

10. A locket according to claim 1, wherein said covers are of substantially the same area and shape.

11. A locket according to claim 1, wherein said covers each have an annular wall one side surface of which defines a cover rim surface and the other side surface, opposite surface, of which defines in part an annular recess, said cover bodies having an inner surface which at its peripheral region also part-defines said annular recess.

12. A locket according to claim 11, wherein said annular recess is adapted to receive one or more items.

13. A locket according to claim 12, wherein said items may be pictures, photographs, plates, protective panels, packing sheets or such like, or a combination therefrom.

14. A locket according to claim 12, wherein said item or items are removable.

15. A locket according to claim 11, wherein a roughened area is provided at the region of said annular recess.

16. A locket according to claim 15, wherein a picture is provided in said recess, and said picture has a peripheral region which engages against said roughened area, said roughened area assisting in retaining said picture in said recess.

17. A locket according to claim 1, wherein said leaf comprises a recess adapted to receive one or more items.

18. A locket according to claim 17, wherein said items may be pictures, photographs, plates, protective panels, packing sheets or such like, or a combination therefrom.

19. A locket according to claim 17, wherein said item or items are removable.

20. A locket according to claim 1, wherein said front cover, said back cover and said leaf are connected together at a common hinge.

* * * * *

UNITED STATES PATENT AND TRADEMARK OFFICE

CERTIFICATE OF CORRECTION

PATENT NO. : 5,651,274
DATED : 29 JULY, 1997
INVENTOR(S) : MICHAEL J. TAYLOR

It is certified that error appears in the above-identified patent and that said Letters Patent is hereby corrected as shown below:

ON THE TITFLE PAGE:

Item [73] Assignee: Change from "Gold Connection Limited, England"

to --The Gold Connection Limited, England--

Signed and Sealed this

Eleventh Day of July, 2000

*Attest:*

Q. TODD DICKINSON

*Attesting Officer*

*Director of Patents and Trademarks*